US005396744A

United States Patent [19]

Mosley

[11] Patent Number: 5,396,744

[45] Date of Patent: Mar. 14, 1995

[54] ELECTRICALLY INDUCED RADON BARRIERS

[75] Inventor: Ronald B. Mosley, Chapel Hill, N.C.

[73] Assignee: The United States of America as represented by the Administrator of the U.S. Environmental Protection Agency, Washington, D.C.

[21] Appl. No.: 140,512

[22] Filed: Oct. 25, 1993

[51] Int. Cl.[6] ..... F02D 31/00

[52] U.S. Cl. ..... 52/169.1; 52/169.5; 52/750; 52/741.3; 52/742; 52/745.05; 405/52; 405/229; 204/134; 204/242

[58] Field of Search ..... 52/169.1, 169.5, 750, 52/741.3, 742, 745.05; 405/52, 53, 229; 204/134, 242

[56] References Cited

U.S. PATENT DOCUMENTS 4,319,854 3/1982 Marzocchi ..... 52/169.5 X
5,101,712 4/1992 Dean ..... 52/169.5 X
5,277,003 1/1994 Myers ..... 52/169.5

*Primary Examiner*—Carl D. Friedman
*Assistant Examiner*—Robert J. Canfield
*Attorney, Agent, or Firm*—Lorusso & Loud

[57] ABSTRACT

A system for forming a blocking layer of water-saturated soil surrounding the foundation of a building to be protected from ingress of radon gas or other soil gas contaminents. The system includes at least one set of parallel positive and negative electrodes positioned in the soil, adjacent and spaced from the foundation. Typically, the negative electrode will be positioned closest to the foundation. A low level voltage is applied to the electrodes from a DC power source. One or more sets of such electrodes will be positioned in the soil surrounding the foundation or at least that portion of the foundation most susceptible to gas ingress.

19 Claims, 6 Drawing Sheets

ELECTRICALLY INDUCED RADON BARRIERS

BACKGROUND OF THE INVENTION

1. Field of the Invention

Apparatus and method for controlling the rate of ingress of radon and other contaminants from the soil into building interiors, thereby reducing exposure of individuals to radon and other soil gas borne contaminants.

2. The Prior Art

Indoor radon has been identified by the United States Environmental Protection Agency (EPA) and the by the United States Surgeon General as the second leading cause of lung cancer in the United States (second only to tobacco smoke). Recent studies have also linked radon with cancers in several other organs of the body, including leukemia in children. An individual's greatest exposure to radon occurs in the indoor environment. Numerous studies have documented that the primary source of indoor radon is radium in the soil. Radon produced by radioactive decay of the radium migrates with the soil gas and enters the building.

One prior approach to controlling entry of radon into buildings is active subslab ventilation (SSV), as disclosed, for example, in U.S. Pat. No. 4,620,398. These systems consist of one or more fans (or similar devices) connected through pipes to the subslab region of a building foundation. Commonly, the connection is formed by drilling holes in the concrete slab floor or subfloor. The fan is oriented to either pressurize or depressurize the subslab region relative to the adjacent interior space (basement or living space). The most common type SSV depressurizes the subslab region relative to the interior space to insure that if air is exchanged between the two spaces the flow will be in the direction from the interior to the subslab space. This direction of flow insures that radon does not enter as a result of the air movement. Applications in which the subslab region is pressurized attempt to force the radon in the vicinity of the foundation or slab away from the building. In practice, this latter technique works primarily by diluting the radon concentration in the soil gas by the introduction of fresh air under the slab. One or the other of these approaches proves to be effective in preventing radon entry into most buildings. The major disadvantages of SSV methods are: 1) cost, 2) lack of effectiveness in some structures, 3) noise and 4) the mechanical systems require maintenance. The cost of this technique ranges from $800.00 to $5,000.00 for residential installations depending on the structure and soil type. A typical installation cost is $1,500.00 for a single family home. Operating costs to run the fan can also be substantial. This relatively high cost appears to serve as a deterrent to implementation of SSV technology. The technique does not work well when the building is placed on low permeability soil with no aggregate (about 20% fail), or when air communications under the slab is blocked (e.g. interior footings, load beams, or heating ducts).

It has been known for many years that water-saturated soil between two electrodes behaves in a manner similar to an electrolytic cell. See Casagrande, L. (1952), "Electro-osmotic Stabilization of Soils," *J. BSCE*, 39, 51–83; Casagrande, L. (1983), "Stabilization of Soils by Means of Electro-osmosis, State-of-the Art," *J. BSCE*, 69(2), 255–302; and Lockhard, N. C. (1982), "Electro-osmotic dewatering of clays, III. Influence of clay type, exchangeable cations, and electrode materials," Colloids Surf., 6, 253–269. When a DC voltage is applied, water will be transported between the electrodes. This electro-osmotic technology has been used to remove water from the soil at construction sites, to stabilize embankments, and to increase loading capacity. This phenomenon is sometimes referred to as electrical drainage. Electro-osmotic effects have also been studied for their potential applications in the cleanup of contaminated soil water. See, Segall, B. A., C. E. O'-Bannon and J. A. Matthias (1980) "Electro-osmotic Chemistry and Water Quality, J. Geotech. Engrg. Div.," *ASCE*, 106(10), 1148–1152; Bruell, C. J., B. A. Segall and M. T. Walsh (1992), "electo-osmotic Removal of gasoline hydrocarbons and TCE from Clay," *J. Envir. Engrg.*, ASCE, 118(1), 68–83; and Segall, B. A. and C. J. Bruell (1992), "Electro-osmotic Contaminant Removal Processes," *J. Envir. Engrg.*, ASCE, 118(1), 84–100.

U.S. Pat. No. 1,175,970 discloses an electro-osmotic system for pulling water toward a crop or plant. As described at page 1, lines 69–80, one electrode would be a series of parallel electrodes or metallic wires and the other electrode would be a series of conducting plates. The latter electrode would be placed at a location "of a maximum water content, or even in a suitable spot at a considerable distance away."

U.S. Pat. No. 4,145,270 discloses an electro-osmotic system in which the foundation wall itself is the positive electrode. As is typical of such art, the system is designed to draw water away from the foundation.

U.S. Pat. No. 4,600,486 discloses electro-osmotic apparatus installed on a foundation wall with a positive grid and a negative grid arranged in a coplanar configuration, with the positive grid being located on the foundation wall, above the negative grid also located on the foundation wall.

U.S. Pat. No. 3,070,528 discloses a damp-proofing arrangement wherein positive and negative grids are arranged on opposite sides of a structure.

SUMMARY OF THE INVENTION

Accordingly, one object of the present invention is to reduce health risks from exposure to radon and other soil gas borne contaminants, e.g. methane or other organic gas.

Another object of the present invention is to enable builders and home owners to install a system to control the rate of entry of radon into the structure from the soil, thereby significantly reducing exposure of individuals to radon.

Yet another object of the present invention is to provide a system and method having the potential to reduce radon levels in most buildings at a cost that is very low in comparison to the traditional radon mitigation technology, e.g. subslab ventilation.

Still another objective of the present invention is provision of a system and method for maintaining the integrity of impervious clay type liners and caps in landfills, hazardous waste containment facilities and radioactive waste storage facilities.

Other objects and further scope of applicability of the present invention would become apparent from the detailed description to follow, taken in conjunction with the accompanying drawings.

Research has revealed that, to a large extent, the gas permeability and gas phase diffusion coefficient of a particular soil are determined by the degree of their saturation with water. The present invention employs a technique called electro-osmosis to produce water migration and capture in a manner to control the geometric shape and thickness of soil layers with low permeability and diffusion coefficient. Consequently, the paths of radon migration near a building can be controlled by maintaining barriers of low permeability and diffusivity in the appropriate regions near the foundation. With this technique, it is also possible to produce zones depleted of moisture or zones with enhanced permeability. Zones of enhanced permeability can be used to enhance the performance of conventional subslab ventilation systems by increasing their pressure field extension.

This invention uses electro-osmotic techniques and static electric fields to modify the air permeability and diffusivity of soil in the vicinity of the building foundation and subslab in such a manner as to either prevent radon entry or to enhance the performance of traditional subslab ventilation technology. Although this invention will be especially suited for installation with newly constructed buildings, it also can be applied to existing buildings as a retrofit solution to indoor radon problems. This technique can be applied to both basement and slab-on-grade construction for residential, commercial, and public buildings.

The present invention fulfills the above objectives by providing a method and apparatus for forming a water-saturated barrier layer in the soil, surrounding a structure to be protected from radon ingress. The apparatus includes at least one set of parallel positive and negative electrodes buried in the soil and positioned adjacent and spaced from the foundation of the structure to be protected from gas, e.g. radon or methane, ingress. One of the electrodes is positioned intermediate the foundation and the other electrode. In the preferred embodiments, this one electrode nearest the foundation is the negative electrode. In the system of the present invention a DC power source provides a voltage across the electrodes. Thus, in the system of the present invention the one set of positive and negative electrodes will be coextensive with at least one dimension of the foundation. That one set of electrodes or plural sets of electrodes will effectively surround the below grade foundation.

The method of the present invention includes positioning the one set of parallel positive and negative electrodes in the soil, adjacent and spaced from the foundation. A DC voltage is applied to the electrodes at a level sufficient to establish a water-saturated soil layer as a barrier to migration of gas. Preferably a current density is maintained at a sufficiently low level that no gas, e.g. gas generated at the electrode, will bubble through the water-saturated layer. Economics dictate that the DC voltage be no more than that required to establish a static electric field sufficient to compensate gravitational forces acting on the water in the water-saturated soil layer. However, other considerations may dictate application of higher voltages.

The present invention has several advantages over the prior art. First, it has the potential to be less costly to install and operate than the prior art. Second, It will perform best in the cases in which the conventional technology is least effective. It will present minimum intrusion into the living space of the home. It will make no noise. When properly installed, it will use little energy. It will not increase the emission of radon into the atmosphere. It has the added potential advantage of moisture control in the building structure and the indoor air.

DESCRIPTION OF THE PREFERRED EMBODIMENTS

Figure 1:
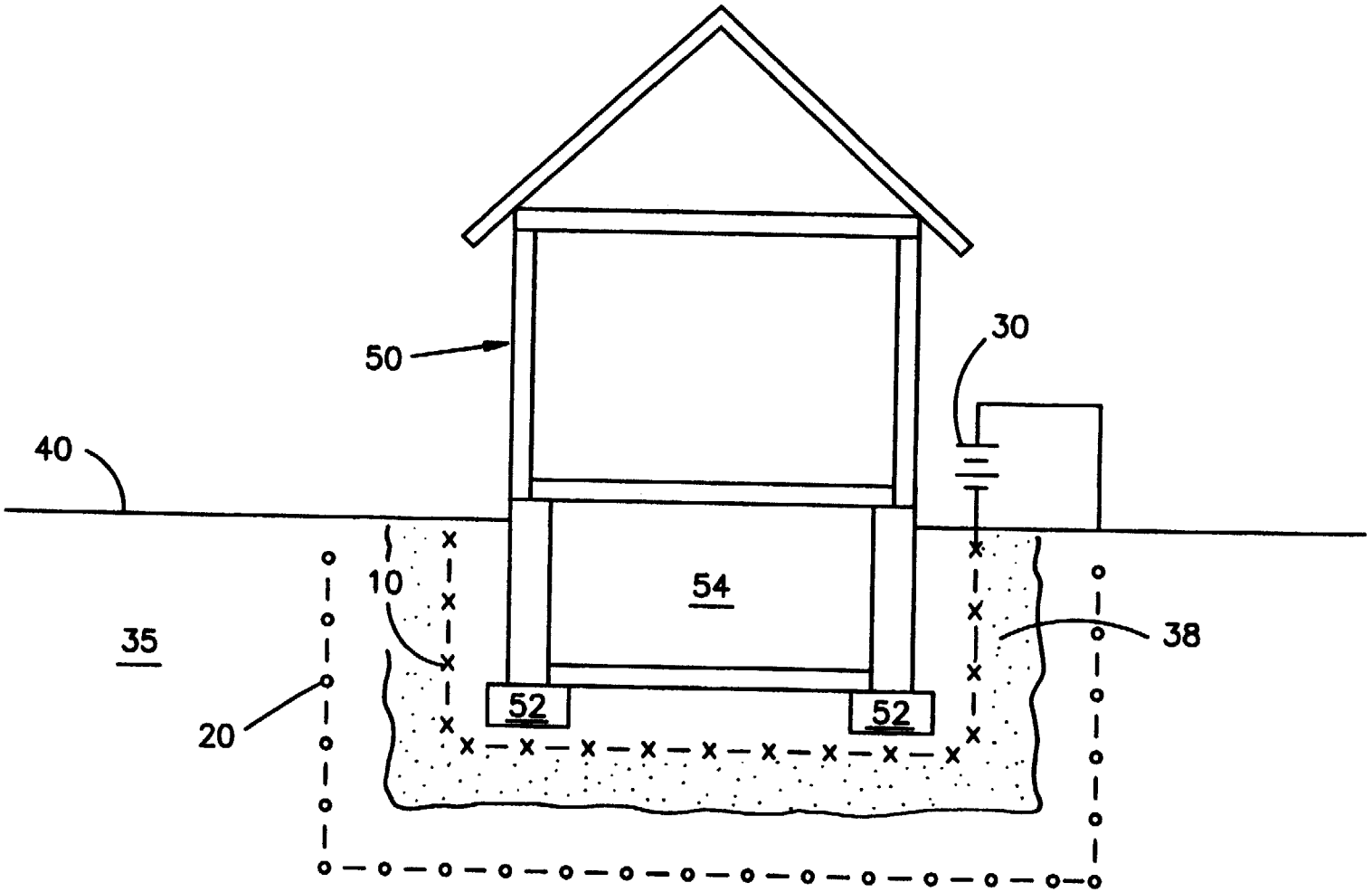
FIG. 1 is a schematic view showing planar, open-grid electrodes in cross-section buried in soil and arranged with respect to a building structure in accordance with one embodiment of the present invention.

The present invention provides a blocking layer of water-saturated soil near the substructure of the building to prevent radon entry. This invention is different from previous applications of electro-osmotic mechanisms to drain soils in that it acts to maintain high levels of moisture in a relatively thin layer geometrically designed to block radon entry into buildings. In the steady state, an ideally designed system would establish a static electric field (with zero current flow) that would maintain a low permeability layer of soil by just compensating for the gravitational forces on the moisture in the layer. In many applications, when zero current cannot be maintained, the DC voltage could be applied intermittently in order to reduce power consumption and to conserve the local moisture that is available. The operation of the power supply could be controlled by a microprocessor using feedback from conductivity measurements (also controlled by the microprocessor). Power consumption would automatically be limited by the fact that the transport of moisture would tend to deplete the zone near the anode of water, thereby reducing the current. In many cases, this self limiting process might be adequate to limit the power consumption. In areas of low precipitation, water could be electrically transported to the layer under the building periodically.

Water can be transported through soil under the action of an applied electric field because ions are present in the soil water. Water droplets will be dragged along with the ions under the action of the applied field. For silicate based clays the dissolved ions are usually positive and therefore the water will migrate toward the cathode (negative electrode). Overall charge neutrality is maintained by oxidation and reduction reactions at the electrodes. In some cases oxygen and hydrogen may be evolved. Under properly designed conditions, it would be possible to maintain a saturated layer of soil without current flowing in the circuit. This could occur if there were no charge transfer at the electrodes and the applied electric field were just sufficient to counteract the forces of gravity and the hydraulic pressures on the water in the soil layer. Under these circumstances, a saturated layer would be maintained with almost no expenditure of electrical energy. For the cases in which gases (such as oxygen and hydrogen) are generated by the electrode reactions, the rate of generation and, therefore, the current density must be kept sufficiently low that the gas does not bubble through the impermeable layer opening flow paths for soil gas.

While the idealized electrode configuration would be parallel planes approximated by open grids with openings having dimensions somewhat smaller than the distance between the planes, there are a variety of electrode configurations that can serve adequately for this technology. It would be acceptable for the anode to have much larger openings than the cathode, especially if the spacing between the anode and cathode were comparable. There will be a cost/performance balance to consider when designing the electrode configuration for a particular application. Some key factors that will influence the design are the typical precipitation patterns, the moisture properties of the soil, and the degree of uniformity of the soil properties. For instance, the electrode design for layered soils in which different layers have different textures and different moisture holding properties will be influenced both by the individual layers and by the interaction between adjacent layers. One approach to optimizing the cost/performance balance between installing closely spaced anode grid points and widely spaced grid points would be to use widely spaced anode grid points (reducing cost of installation) while energizing zones of the cathode that are farther from the anode with higher voltages (increasing the uniformity of the blocking layer and consequently the performance). Another approach would be to energize the adjacent zones of the cathode alternately with the same power supply either for different lengths of time or at different voltages.

Figure 2:
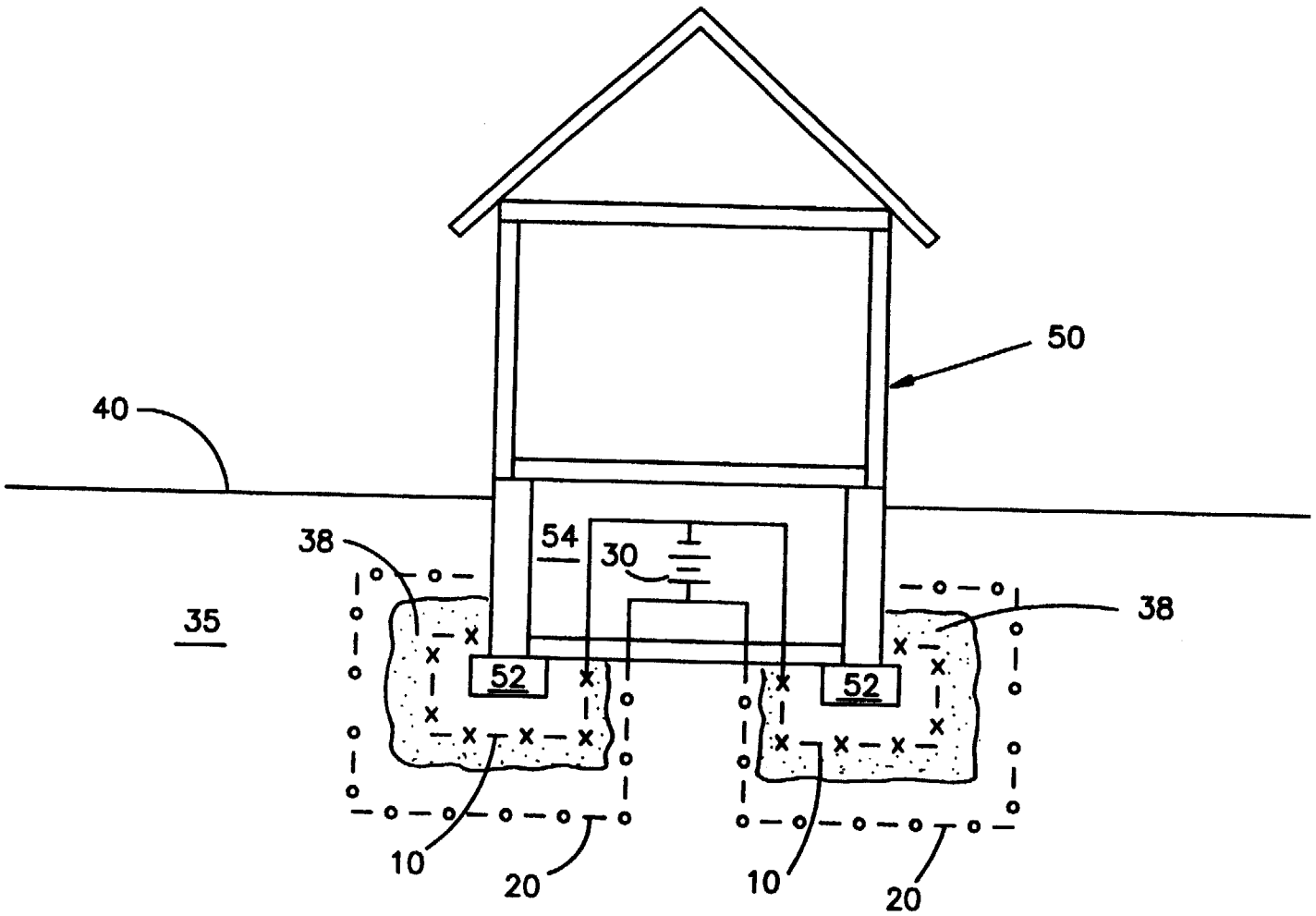
FIG. 2 is a schematic view showing a set of planar, open-grid electrodes in cross-section, buried in soil and arranged in an annular configuration around a footing in accordance with another embodiment of the present invention.

Two preferred electrode configurations are illustrated in FIGS. 1 and 2. FIG. 1 illustrates plane parallel electrodes consisting of open meshes buried in soil 35 below grade level 40. In this case, a low permeability layer of water-saturated soil 38 will form near the cathode 10 (negative electrode) while a current limiting layer will form near the anode 20 (positive electrode). The blocking layer of water-saturated soil 38 is formed in a manner to shield the entire substructure including basement 54 and footings 52 of the building 50 from entry of soil gas containing such pollutants as radon, pesticides, or organic contaminants from waste storage sites or leaking storage tanks. This configuration of electrodes would be most easily installed during construction of new buildings.

The idealized electrode configuration illustrated in FIG. 2 would be more applicable in the retrofit of existing buildings. The electrodes 10, 20 are arranged in an annular configuration in a manner to form blocking layers of soil 38 to shield the perimeter of the substructure from entry of soil gas, i.e. surrounding footing 52 of the foundation. This design is appropriate for two reasons. One, the perimeter is more easily accessible for installation of the electrodes in an existing building. Two, the most important radon entry routes are believed to exist at the perimeter of the building. The foundation, the walls, and the wall-floor joint are frequently the primary radon entry routes.

In the embodiments of FIGS. 1 and 2 the electrodes 10, 20 will typically be spaced 2" to 24" apart. A dryer soil will require a spacing toward the upper end of this range. The grids or meshes may be conductive overall or may consist of point electrodes interconnected by insulated wires.

Figure 3:
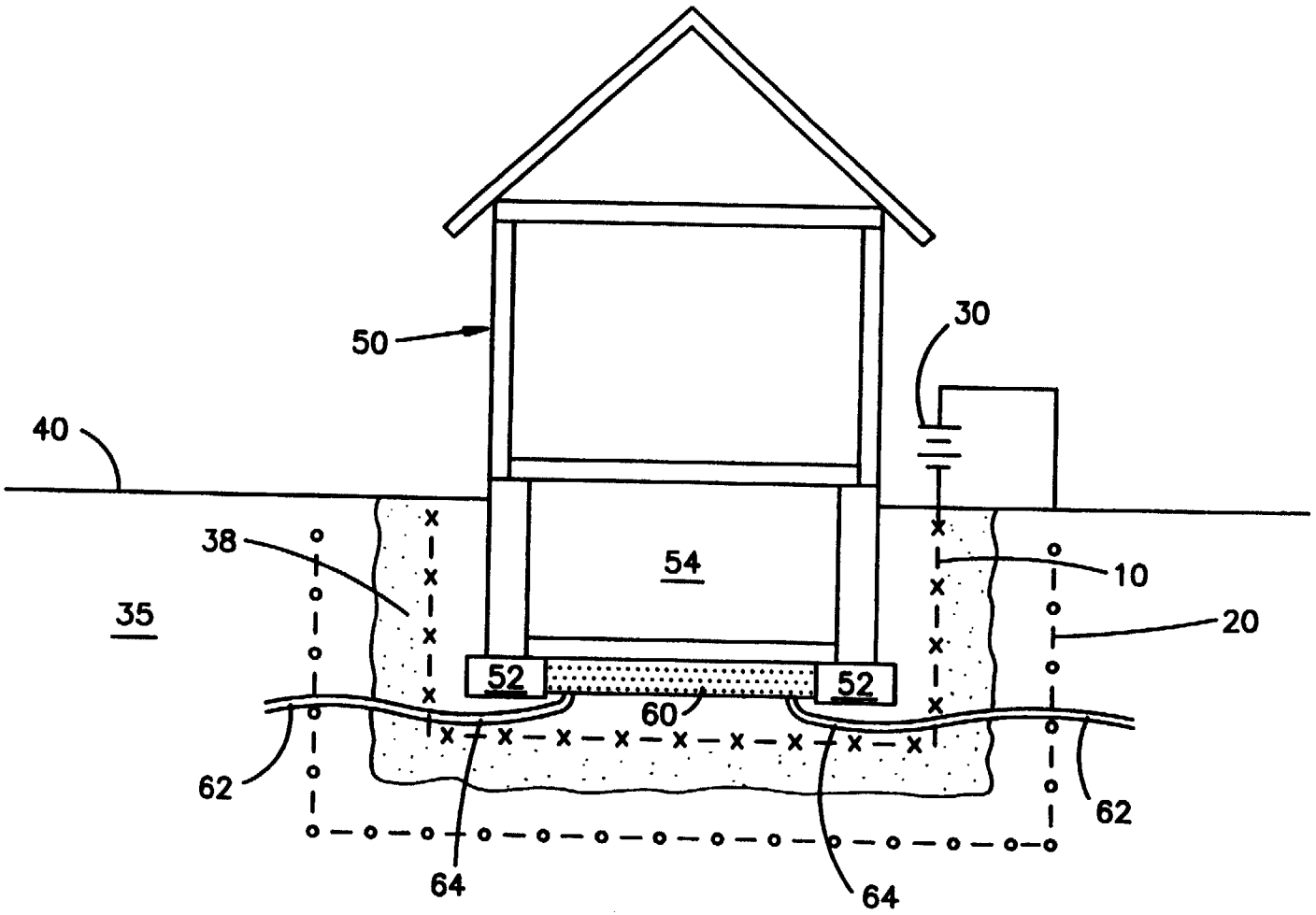
FIG. 3 is a schematic view similar to FIG. 1 showing the arrangement of FIG. 1 applied to a structural foundation having an aggregate drain.

FIG. 3 illustrates a radon prevention design for the construction of a new basement house 50. The aggregate bed 60 with drains 62 provides drainage of water that inadvertently gets under the building. The electrodes 10, 20 provide a barrier to block radon transport. The drainage lines 62 for the aggregate bed 60 contain traps 64 that would stay filled with water to prevent soil gas from reaching the aggregate region. In very dry climates, it might be desirable to provide a means of filling the traps 64 (such as a capped fill line to the surface or a trickle fill line). The design of the electrodes for a slab-on-grade house with aggregate would be very similar to that of FIG. 3.

Figure 4:
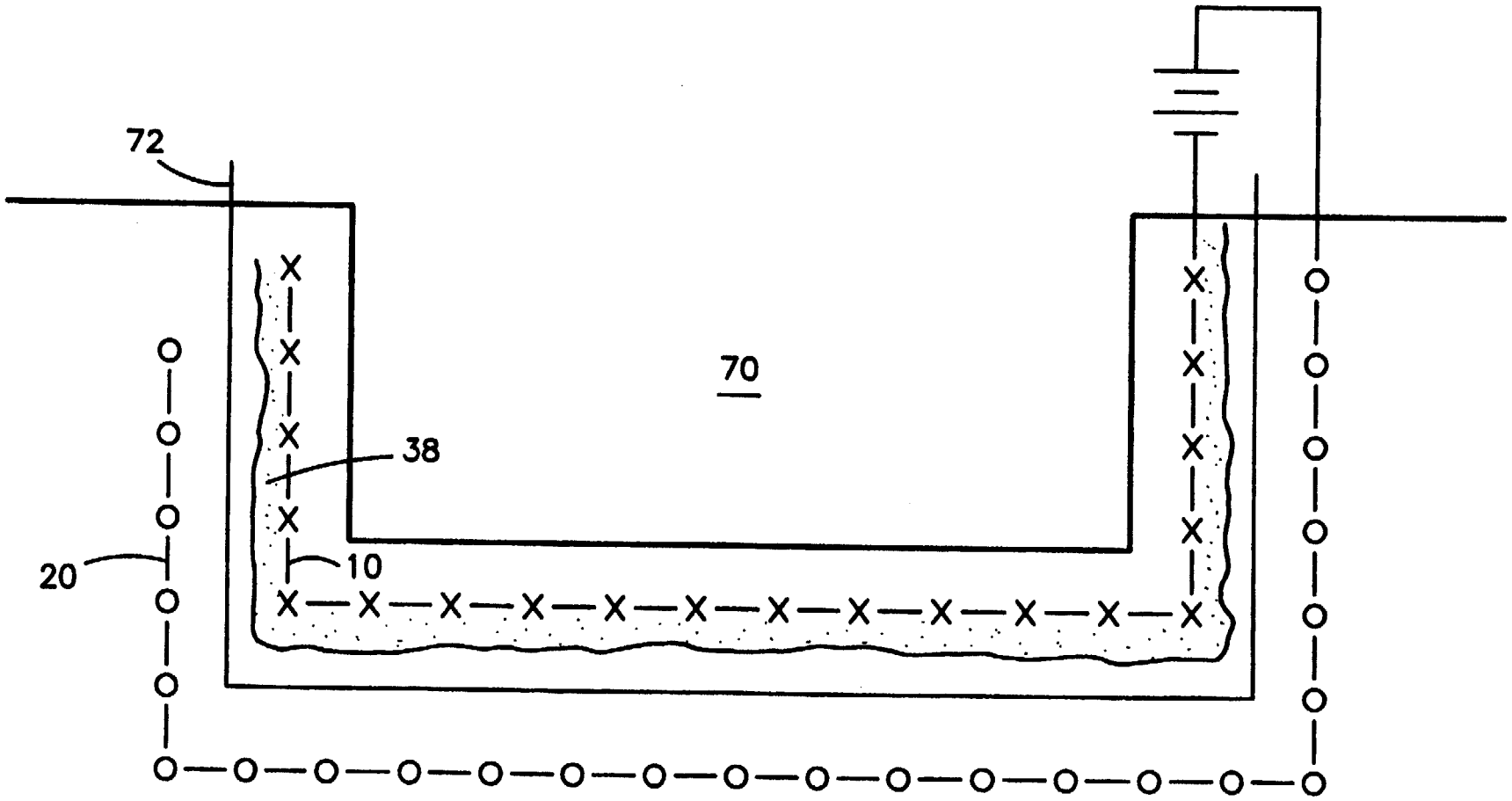
FIG. 4 is a schematic view showing planar, open-grid electrodes in cross-section buried in soil and arranged with respect to a waste container in accordance with another embodiment of the present invention.

FIG. 4 illustrates an electrode configuration to be employed with a waste containment facility 70 such as a landfill, a hazardous waste facility, or a radioactive waste facility. The thickness of the blocking layer 38 will be determined by the spacing of the electrodes 10, 20, the applied voltage, and the characteristics of the soil hydrology. The application will determine the desired minimum thickness of the blocking layer. Water may be added, if necessary through irrigation pipes 72. A cap for such a storage facility to keep out surface water would look somewhat similar to an inversion of FIG. 4.

Figure 5:
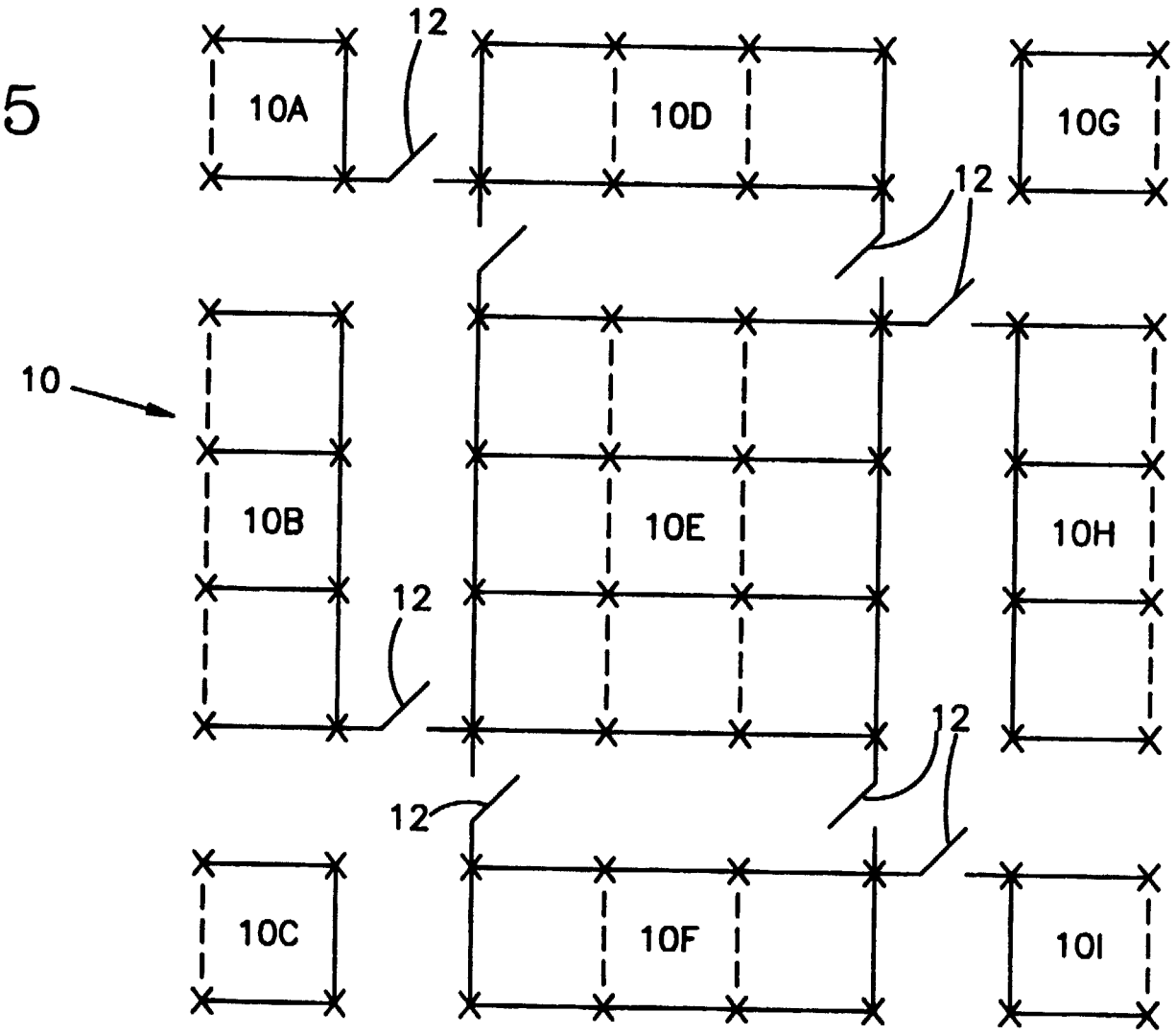
FIG. 5 is a planar view of one embodiment of a cathode suitable for use in the present invention.

FIG. 5 illustrates the manner in which the cathode 10 would be segmented into zones 10A–10I. The isolation of individual zones is illustrated by switches 12. These switches 12 could be controlled manually, or electronically using a microprocessor. The electrical conductivity of each zone could be measured periodically to determine whether the integrity of the blocking layer was holding. These tests could be performed automatically under the control of a microprocessor. If the blocking layer had lost too much moisture, it could be replenished locally under the control of the same microprocessor.

In another embodiment, this invention is to enhance the performance of a conventional SSV system. Since the soil near the anode will tend to be depleted of moisture, the permeability in this area will increase. By carefully designing the electrode configuration a zone of enhanced permeability that could improve the communication of a conventional SSV system. This could provide communication under a physical blockage such as a load beam or a subslab heating duct. A layer of higher permeability soil could be maintained under the entire building. This implementation would require the anode to be nearest the building foundation. The performance of the conventional SSV system would be improved not only by improving communication in the subslab region, but also by the formation of an underlying blocking layer near the cathode.

Figure 6:
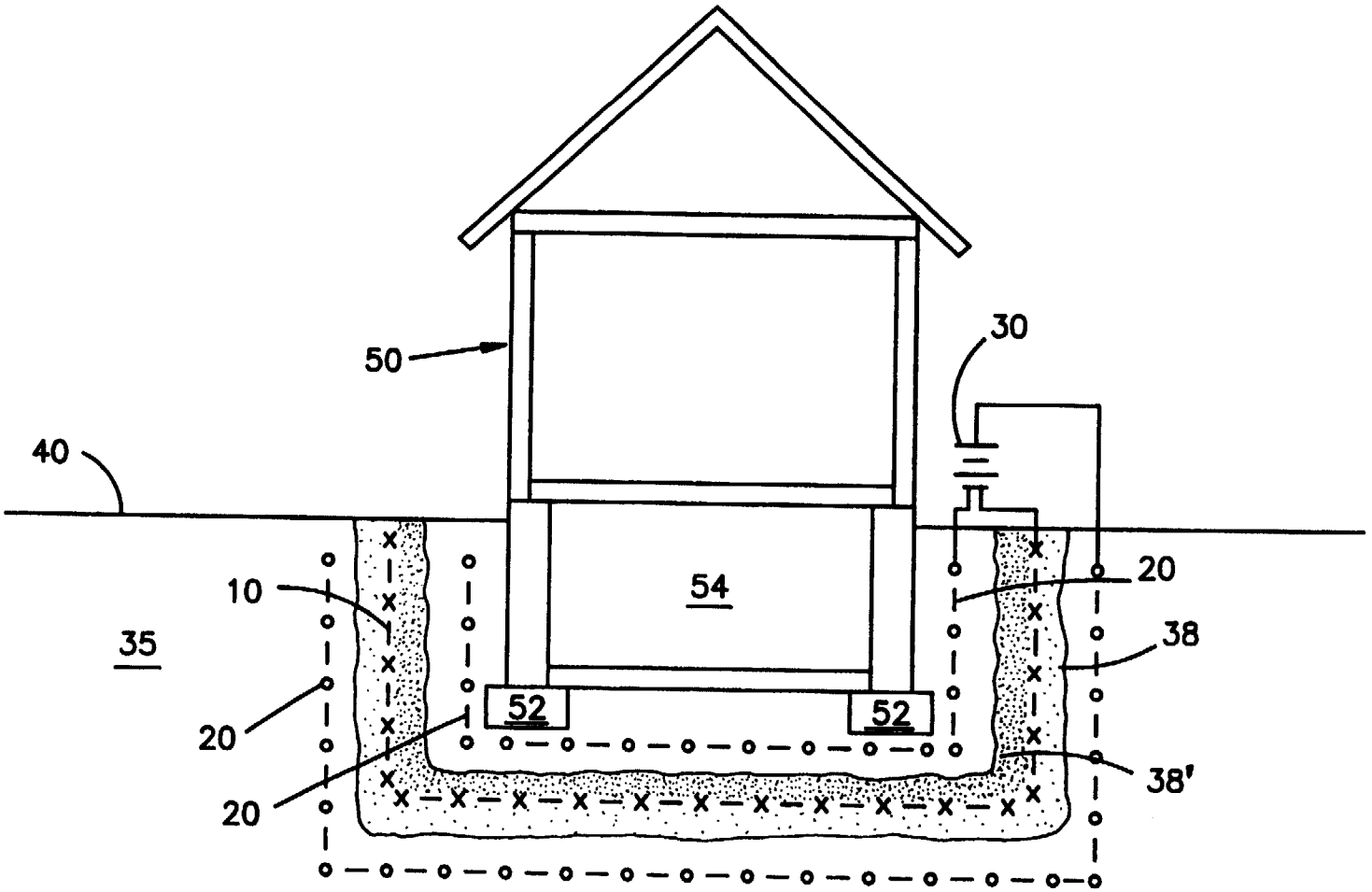
FIG. 6 is a schematic view of an embodiment similar to FIG. 1 but employing an additional, third electrode.

In yet another embodiment the invention could be adapted to transport moisture away from the foundation and slab of a building to prevent moisture from entering the building. By the proper arrangement of the electrodes, moisture control can be maintained simultaneously with the radon blocking layer. In fact, it will be noted that this objective will be consistent with the configuration described above in which the anode is located nearest the substructure. In many soils, the most effective configuration for achieving the foregoing objective will be to sandwich the cathode between two anodes such that moisture is transported away form the foundation with closely spaced electrodes while moisture is transported toward the foundation from below the cathode with more widely spaced electrodes. This electrode configuration, as shown in FIG. 6, would optimize the performance of the blocking layer by reducing the effectiveness of the negative pressure in the building to transport soil gas through the barrier. This effect occurs because the induced gas flow short-circuits through the higher permeability soil 38' above the barrier. The three planar electrode configuration of FIG. 6 thus serves to dry the soil above the barrier, i.e. between the barrier and the below grade structure to be protected, making that dryer layer of soil 38' more gas permeable, thereby allowing the ambient atmosphere above grade to permeate down into the soil and provide a clean air purge of that soil intermediate the barrier and the structure which is protected. As noted above, this ingress of clean air through the layer of soil of enhanced permeability also serves to counterbalance the driving force on soil gas through the barrier which would otherwise exist due to the lower pressure within the protected, below-grade structure, e.g. building foundation or basement.

Other embodiments of the invention could provide an impervious barrier in the form of a saturated clay layer for containment or capping of liquids and chemicals in landfills, and hazardous waste disposal facilities. This type of containment could also be applied to radioactive waste containment facilities. In this implementation, a static electric field would maintain a layer of clay saturated with water to prevent liquids and chemicals from draining or leaching through the barrier. If needed, water could be periodically supplied to the layer through a network of perforated distribution pipes. The electrodes would be sectioned into isolatable zones for which local soil conductivity could be measured under the control of a microprocessor. A local irrigation system could be controlled by the same microprocessor. Only enough water to replace the loses through electrode reactions should be required. These applications that require long term performance would require substantial mass in the electrodes since the metal (such as iron or carbon) would be continuously lost in the electrode reactions. Significant redundancy in electrical connections and power sources would also be required. In some applications, appropriately sealed electrets might serve as the voltage source (In this case, the field would be static with no steady state current.).

EXAMPLE

The feasibility of the process of the present invention to form a blocking layer was tested using a laboratory device which consisted of a cylinder 3 inches in diameter and about 14 inches in length. The cylinder was filled with moist soil and a potential of 14 volts was applied between two mesh electrodes separated by about 8 inches. Pressure was applied to produce an air flow of about 1 liter per minute through a fitting half way between the ends of the tube. The out flow was measured through fittings at both ends of the tube. While the voltage was applied continuously, the flow was maintained only during measurements which were performed two or three times a day. After 11 days, no measurable flow passed through the left end (the end with the cathode) while all the flow passed through the right end (the end with the anode). The polarity was then reversed (left end positive). After 7 days, the flows through the two ends were about equal. After 20 days, more than 90% of the flow was passing through the left end (the end with the anode). The polarity was reversed once again (left end negative) and the applied voltage increased to 100 volts. After 6 days, 75% of the flow was passing through the right end (the end with the anode). During the course of these tests, the relative value of the soil permeability near the electrodes was observed to change by about a factor of 20. Model calculations of the radon transport and entry processes indicate that a soil layer a few inches thick with a permeability 20 times lower than the surrounding soil can be quite effective in blocking soil gas entry into the structure.

The principal utility of the invention will be to reduce indoor radon levels in the U.S. housing stock and consequently, reduce the public's risk of lung cancer. The invention would also be applicable to the control of other pollutants that enter the indoor environment with soil gas (e.g. pesticides, biological agents, organic agents from landfills or leaking underground tanks). The invention will also be applicable to the control of moisture entering a building from the soil.

An equally important alternative application of this invention would be to maintain the integrity of impervious clay type liners and caps in landfills, hazardous waste containment facilities, and radioactive waste storage facilities. By maintaining the moisture in the clay type liner near the saturated condition, the layer would be impervious to advective transport of water and chemicals contained above the layer. For the case in which significant quantities of liquid are contained above the liner, it may be necessary to use somewhat higher field strengths to compensate for the hydraulic pressure generated by the liquid.

Another potential application of this invention would be to prevent loss of moisture from clay soils under the foundations of buildings. Consequently, stabilizing the soil and preventing movement of the foundation.

The invention may be embodied in other specific forms without departing from its spirit or essential characteristics. The present embodiments are, therefore, to be considered in all respects as illustrative and not restrictive, the scope of the invention being indicated by the claims rather than by the foregoing description, and all changes which come within the meaning and range of the equivalents of the claims are therefore intended to be embraced therein.

I claim:

1. A system for forming a blocking layer of water-saturated soil preventing ingress of a gas into a building structure, said apparatus comprising:

at least one set of parallel positive and negative electrodes buried in the soil and positioned adjacent and spaced from the structure, one of said electrodes being positioned intermediate the structure and the other of said electrodes; and a DC power source for applying a voltage between said electrodes.

2. A system in accordance with claim 1 wherein said one electrode is the negative electrode.

3. A system in accordance with claim 1 wherein at least one of said positive and negative electrodes is planar.

4. A system in accordance with claim 3, wherein said planar electrode is an open grid.

5. A system in accordance with claim 1, wherein said positive and negative electrodes are both planar.

6. A system in accordance with claim 5, wherein said planar electrodes are open grids.

7. A system in accordance with claim 1 wherein said electrodes are spaced 2" to 24" apart.

8. A system in accordance with claim 1, wherein the building includes a foundation and the foundation structure is surrounded by at least one set of said positive and negative electrodes.

9. A system in accordance with claim 1 wherein said building includes a below grade basement and said basement is surrounded by at least one set of said positive and negative electrodes.

10. A system in accordance with claim 1, wherein said building includes a below grade foundation and wherein said one set of positive and negative electrodes is coextensive with at least one dimension of the below grade foundation.

11. A system in accordance with claim 4, wherein said open grid has openings with all dimensions of each opening smaller than the distance between said positive and negative electrodes.

12. A system in accordance with claim 5 further comprising a second planar positive electrode with the negative electrode positioned intermediate the two positive electrodes.

13. A system in accordance with claim 12 wherein said negative electrode is spaced from each of said positive electrodes by a distance of 2" to 24".

14. A method for preventing ingress of a gas through soil into a a building structure, said method comprising:

positioning at least one set of parallel positive and negative electrodes in the soil adjacent to and spaced from the building structure with one of said electrodes located between the building structure and the other of said electrodes; and applying a DC voltage across said positive and negative electrodes to establish a water-saturated soil layer between said electrodes.

15. A method in accordance with claim 14, wherein said one electrode is the negative electrode.

16. A method in accordance with claim 14, wherein said positive and negative electrodes define respective parallel planes.

17. A method in accordance with claim 16, wherein at least one of said positive and negative electrodes is an open grid.

18. A method in accordance with claim 14, further comprising:

maintaining a current density in said electrodes sufficiently low that gas does not bubble through said water-saturated layer.

19. A method in accordance with claim 14, further comprising, after establishing said water-saturated soil layer, intermittently applying a DC voltage to maintain a static electric field between said electrodes sufficient to compensate for the gravitational force acting on water in the water-saturated soil layer, thereby maintaining the water-saturated condition of the soil layer.

* * * * *